US006938415B2

(12) United States Patent
Last

(10) Patent No.: US 6,938,415 B2
(45) Date of Patent: Sep. 6, 2005

(54) HYDRAULIC/PNEUMATIC APPARATUS

(76) Inventor: Harry L. Last, 1010 Koohoo Pl., Kailua, HI (US) 96734

( * ) Notice: Subject to any disclaimer, the term of this patent is extended or adjusted under 35 U.S.C. 154(b) by 37 days.

(21) Appl. No.: 10/758,666

(22) Filed: Jan. 15, 2004

(65) Prior Publication Data

US 2004/0146406 A1 Jul. 29, 2004

Related U.S. Application Data

(63) Continuation-in-part of application No. 09/829,801, filed on Apr. 10, 2001, now Pat. No. 6,827,120.
(60) Provisional application No. 60/440,667, filed on Jan. 15, 2003.

(51) Int. Cl.[7] ..... E06B 9/08
(52) U.S. Cl. ..... 60/432; 60/484; 4/502; 160/133
(58) Field of Search ..... 60/423, 431, 432, 60/484; 4/500, 502, 503; 160/133, 188

(56) References Cited

U.S. PATENT DOCUMENTS 1,551,512 A * 8/1925 Goff ..... 200/47
3,613,126 A * 10/1971 Granderath ..... 4/502
3,718,215 A * 2/1973 Mimeur ..... 192/141
5,913,613 A * 6/1999 Ragsdale et al. ..... 4/502
6,324,706 B1 * 12/2001 Epple ..... 4/502

FOREIGN PATENT DOCUMENTS

DE 3032277 A * 7/1982 ..... E04H/3/19

* cited by examiner

*Primary Examiner*—Thomas E. Lazo
(74) *Attorney, Agent, or Firm*—David E. Newhouse, Esq

(57) ABSTRACT

An invented fluidic (hydraulic/pneumatic) actuation system is described wherein bidirectional, hydraulic/pneumatically driven elements of multiple components in a common hydraulic/pneumatic circuit inherently provide increases in pressure upon reaching mechanical end points limiting, arresting or stopping further mechanical movement or travel of the driven element of any particular component that switches a sequencing valve system and/or electro-hydraulic/pneumatic pressure switches for directing hydraulic/pneumatic power to other hydraulically/pneumatically driven components in the hydraulic/pneumatic circuit in a timed, sequenced and velocity controlled manner.

9 Claims, 7 Drawing Sheets

HYDRAULIC/PNEUMATIC APPARATUS

RELATED APPLICATIONS

This application relates to U.S. Provisional Patent Application Ser. No. 60/440,667 filed Jan. 15, 2003 entitled APPARATUS AND METHOD FOR OPENING AND CLOSING A POOL COVER DRIVE CHAMBER, which is incorporated herein by reference in its entirety, and claims any and all benefits to which it is entitled thereby.

This application is also a continuation-in-part of U.S. patent application Ser. No. 09/829,801 filed Apr. 10, 2001 now U.S. Pat. No. 6,827,120 entitled AUTOMATIC POOL COVER SYSTEM USING BUOYANT-SLAT POOL COVERS [PUB. APP. NO. 20020046817]

BACKGROUND OF THE INVENTION

1. Field of the Invention

This invention relates to a hydraulic or pneumatic actuation system for switching hydraulic/pneumatic power to different hydraulically/pneumatic driven components of automatic swimming pool cover systems in a timed, sequenced, and velocity controlled manner. The invented system is particularly appropriate for passively responding buoyant slat pool cover systems.

2. Description of the Prior Art

Automatic pool cover systems utilizing interconnected rigid buoyant slats which roll up on a submerged or elevated drum popular in Europe are described by U.S. Pat. No. 3,613,126, R. Granderath. These pool cover systems utilize passive forces arising from buoyancy or gravity for propelling or extending the cover across a pool. With either buoyancy or gravity, there must be some mechanism to prevent a retracted cover from unwinding responsive to the passive force. Such passive force systems also have a disadvantage in that the passive force must be overcome during retraction. Granderath teaches a worm gear drive mechanism for winding the cover and preventing cover drum rotation when not powered. The slats for such pool cover systems are further described in U.S. Pat. No. 4,577,352, Gautheron.

U.S. Pat. No. 4,411,031 Stolar describes a system similar to Granderath where instead of rigid hinged buoyant slats, various floating sheet materials such as a polyethylene polybubble, or a laminate of vinyl sheeting and foamed substrate, are floated on the surface of the water. Similar to Granderath extension the cover across the pool is reliant on buoyant and gravitational forces.

Pool covers which employ floating slats or like materials, that depend on buoyancy to propel the cover across the pool, most typically wind the cover onto a roller drum which is positioned below the water surface. When the cover is fully retracted from the swimming pool surface and fully wound onto the cover drum, the upper extremity or front/leading edge of the cover and drum typically are at least two inches below the water surface of the pool. In some cases, the cover and drum are located in a separate water filled niche next to the pool. In other instances the cover and drum may be located near the bottom of the pool, or in a special hidden compartment underneath the pool floor to aesthetically hide the cover and roller drum, and so that the mechanism does not interfere with swimmers.

Many known European buoyant pool cover systems include a hinged lid covering an under water cover drum assembly enclosure. Typically, the hinged lid is shortened so as to leave a gap or aperture sufficient through which the slatted cover to pass on extension and retraction. The front/leading edge portion of the cover is not fully retracted beneath the lid and left, so as to lead the cover properly through the aperture upon allowing the cover to unwind from around the cover drum on extension passively driven by buoyancy. This is important because if the cover does not feed properly through the aperture, and becomes obstructed or jams, the cover would continue to unwind "crumpling" and expanding diametrically and underneath the lid causing severe damage to the cover slats.

Also Health and Safety inspectors in many jurisdictions in the United States and elsewhere as well as insurance companies, do not allow or will not insure swimming pools which have underwater apertures that can entrap a swimmer. In short, for safety reasons, underwater pool cover assembly trenches/wall recesses must be completely enclosed, requiring a lid assembly completely covering the trench/recess and some mechanism for opening the lid to allow cover deployment and then closing the lid after cover retraction.

Another problem with slatted and other buoyant pool cover systems that emerge from an underwater trench in a pool floor or an underwater recess in sidewall of a pool, is that the cover initially moves vertically due to buoyancy, and upon breaking the water surface, changes direction due to gravity to float horizontally across the pool surface. Typically, measures are be taken to somehow mechanically force the front/leading edge of a buoyant cover to assume a proper orientation and direction upon emerging vertical out the pool surface so that it flops in the proper horizontal direction. For example, often the leading slat component section is pre-bent or fixed in an orientation towards the desired direction of horizontal travel. Pre-bending doesn't work when the front/leading edge is a foot or more below the water surface. In such instance the 'pre-bending' and the cover will often "snake" back and forth below the water making direction of travel relative to the vertical upon breaking water surface unpredictable. A solution is to slow the travel to the buoyant cover in the unwinding direction sufficiently to off set the acceleration forces due to buoyancy effectively controlling extension, until the front/leading edge of the cover breaks water surface.

German patent DE 3032277 A1 R. Granderath. a pool floor cover system lid covering system is described that includes an air bladder induction system for opening a lid of a cover drum assembly enclosure prior to allowing the cover to unwind to close when the cover is fully retracted. German patent DE 198 07576 A1, K. Frey describes a floating door that is mechanically moved vertically from covering an underwater pool cover trench in the floor of the pool to the water suface by means of a cables wound up on reels. K Frey also describes a worm gear reducer drive similar to that used to drive the pool cover drum driving the door closing system, The common practice (presented in trade show exhibits and actual installations) is to actuate a hinged lid system covering an underwater pool cover trench or wall recess with a separate worm gear reducer drive powered by an electric motor and connected to the hinged lid shaft. Electric-mechanical limit switches devices are typically used to stop lid opening at the suitable point that allows the buoyant cover to unwind from around the cover drum with out interference due to the lid. To explain, depending on the thickness of the particular buoyant cover, hinged lids normally only have to rotate 40 to 60 degrees from the horizontal in the case of a pool cover trench and 30 to 50 degrees from the vertical in the case of a side wall recess to create a sufficient aperture for a buoyant cover to pass through on its way to the water surface.

Separate gear drive systems for pool cover enclosure lids with associated limit switches governing travel for such a limited distances are costly. Further, timing of the drive systems must be coordinated with those restraining/driving cover drum rotation on cover extension/retraction. Furthermore, electric drives necessitate the supply of electrical current proximate the swimming pool, creating a shock safety hazard. Moreover electrical components in a moist pool environment are subject to galvanic corrosion rendering them unreliable over time.

SUMMARY OF THE INVENTION

An invented hydraulic/pneumatic actuation system for hydraulically/pneumatically power components is described wherein bidirectional, hydraulic/pneumatically driven elements of multiple components in a hydraulic/pneumatic circuit inherently provide increases in pressure upon reaching mechanical end points limiting, arresting or stopping further mechanical movement or travel of the driven element of any particular component that switches a sequencing valve system and/or electro-hydraulic/pneumatic pressure switches for directing hydraulic/pneumatic power to other hydraulically/pneumatically driven components in the hydraulic/pneumatic circuit in a timed, sequenced and velocity controlled manner.

A distinct advantage of the invented hydraulic/pneumatic actuation system is that pressure increases inherently result in the hydraulic/pneumatic supply line connecting between any particular hydraulic/pneumatic component and the hydraulic/pneumatic power source when the particular bidirectional driven element of that component reaches its respective mechanical end points arresting or stopping further mechanical movement or travel. These respective mechanical end point pressure increases are utilized to actuate remote electro-hydraulic/pneumatic pressure switches at a remotely located hydraulic/pneumatic power pack to either stop a power pack pump motor, and/or cause a combination of a sequencing valves to advance or direct hydraulic/pneumatic fluid flow (power) to drive another element in another component within the hydraulic/pneumatic circuit.

For example, in context of pool cover system, the hydraulic/pneumatic cylinder of the invented hydraulic/pneumatic actuation system would mechanically be coupled for opening and closing a pool cover enclosure lid where the generated mechanical end point pressure increase switches sequencing valves to advance or direct hydraulic/pneumatic fluid flow (power) to drive the cover drum for unwinding or resisting unwinding of a pool cover with the lid in the open position, and shutting off the remotely located power pack via an electro-hydraulic/pneumatic pressure switch when the cover is fully extended, or on cover retraction, the pool cover is completely wound up around the cover drum and cover drum the enclosure lid closes.

One of the novel feature the invented hydraulic/pneumatic actuation system is elimination of two or more of supply lines connecting between a source of hydraulic/pneumatic power and the components of the hydraulic/pneumatic circuit by a flow diverter that isolates vent ports of the sequencing valves from pressure supply lines thus allowing the vents to be connected to the lower pressure return lines.

Another aspect of the invented hydraulic/pneumatic actuation system is that the speed of the driven element and consequently the velocity of a particular operation can be easily and simply controlled by a pressure valve in combination with a timed fluid flow diversion.

A particular advantage of the invented hydraulic/pneumatic actuation system is that it responds digitally, i.e., the pressure increases, switching or redirecting fluid flow inherently correspond to the respective mechanical end points limiting, arresting or stopping further mechanical movement or travel of the bidirectional driven element of the particular hydraulic/pneumatic component.

DETAILED DESCRIPTION OF EXEMPLARY AND ACTUAL EMBODIMENTS OF THE INVENTION

The invented hydraulic or pneumatic actuation system is presented in context of hydraulically powered automatic swimming pool cover systems such as those Applicant described in U.S. Pat. No. 5,184,357 entitled AUTOMATIC SWIMMING POOL COVER WITH A DUAL HYDRAULIC DRIVE SYSTEM, and U.S. Pat. No. 5,546,751 entitled ANTI-CAVITATION MANIFOLD FOR DRIVE COUPLED, DUAL MOTOR, REVERSIBLE HYDRAULIC DRIVE SYSTEMS, modified for driving buoyant slatted or floating pool cover systems, both of which are incorporated herein reference.

Figure 1:
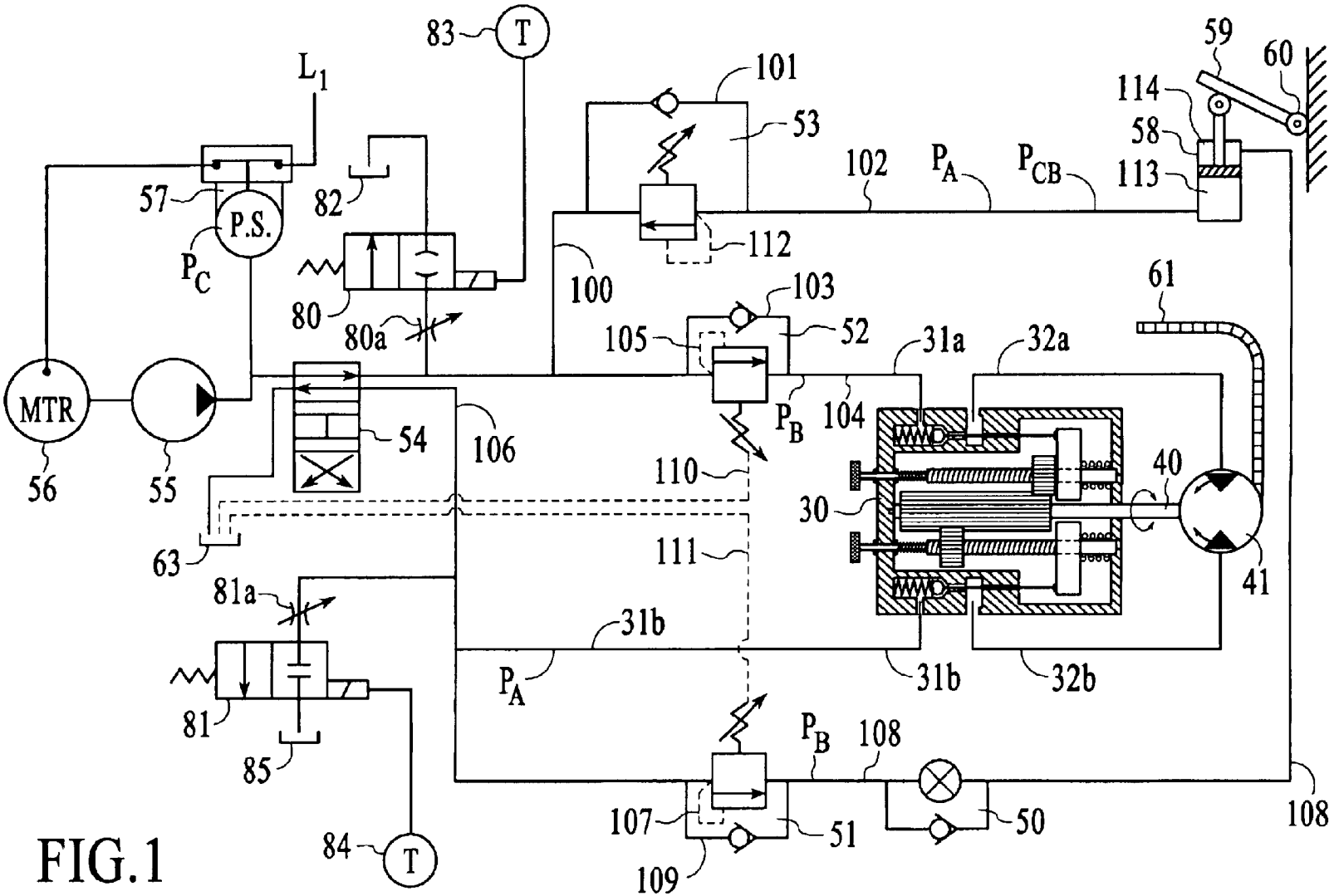
FIG. 1. illustrates a schematic of the invented hydraulic or pneumatic actuation system in a combination for first, automatically opening a cover drum enclosure lid, driving the cover drum for extending a buoyant (floating) cover and turning off the system, and second, automatically driving the retracting the buoyant (floating) cover and closing the cover drum enclosure lid and turning off the system.

Looking at FIG. 1, when operating a buoyant slatted or floating cover system in conjunction with a lid covering system, it is important to ensure that the lid 59 is first fully opened before the cover 61 is allowed to move from its fully retracted position. Likewise, it is important assure that the lid 59 has not drifted closed before retracting the cover 61 from its fully extended position covering the pool.

The invented hydraulic/pneumatic actuation system insures that movement of the cover system cannot be initiated before the lid is fully open, and likewise, that movement of the lid cannot be initiated before the cover is fully retracted. Furthermore, upon operator initiation, the invented system will automatically complete either an extension or retraction cycle, i.e., in the extension cycle, of opening the lid, and when the lid is fully open, then initiate cover extension unwinding the cover from around the cover drum and stopping the system on the cover being fully extended, automatically, or in the retraction cycle, retracting the cover winding it around the cover drum, then allowing the cover drum enclosure lid to close gravitationally, and shutting off the system when the cover drum lid can completely close, automatically.

In more detail, as shown in FIG. 1, in the extension cycle, an electric drive motor 56 is connected for driving pump 55 the fluidic output of which, monitored by pressure switch 57, is directed through a three position control valve 54. In the valve position illustrated, pressurized fluid passes from the pump 55 and the control valve 54 through to a free flow line side 101 of a counterbalance valve 53, to hydraulic/pneumatic cylinder 58 mechanically coupled for pivoting a lid system 59 on hinges at point 60. Pressure in line 102 is initially at a pressure $P_a$ sufficient to move the cylinder shaft 114 connected to lid 59 to move upward. Flow to the cover drive system through line 31(*a*) is temporarily blocked by sequence valve 52, until sufficient pressure is reached through pilot line 105 to open the valve. When the cylinder shaft 114 is in the fully extended position, pressure will build in the cylinder until it reaches pressure $P_b$ which will open sequence valve 52 directing flow to line 31(*a*) through a port of limit switch 30 to line 32(*a*) to hydraulic drive motor 41 driving and/or resisting the cover drum rotation for unwinding a buoyant slat or floating cover 61.

Figure 7:
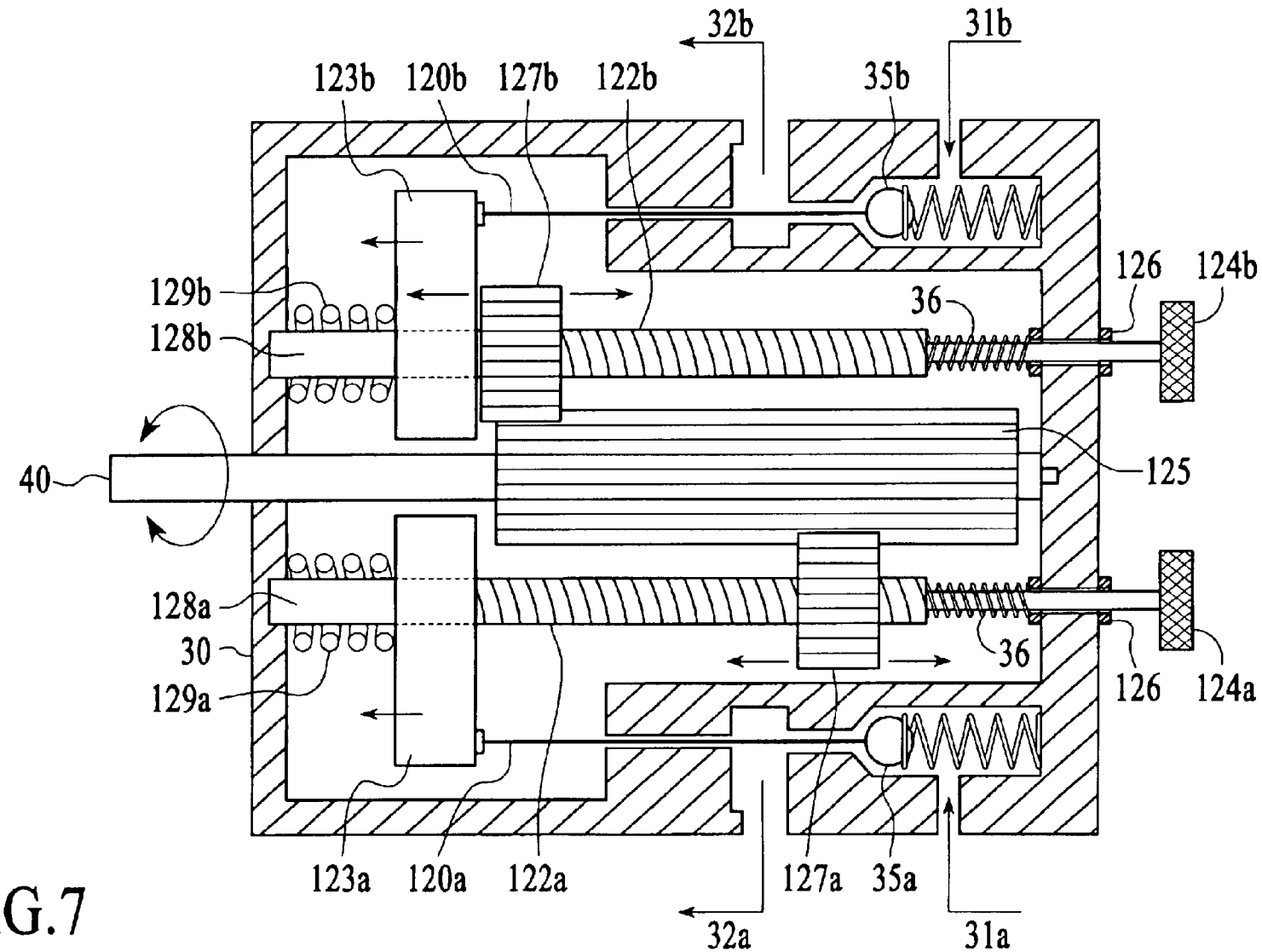
FIG. 7 illustrates in detail the limit device incorporated in the system.

In the retraction cycle, as shown in FIGS. 1 & 7, electric drive motor 56 is connected for driving pump 55 the fluidic output of which, monitored by pressure switch 57, is directed through the three position control valve 54 which is positioned for directing pressurized fluid from the pump 55 to supply lines 106/31(*b*) through limit switch 30 to line 32(*b*) for driving rotation of the cover drum 41 for retracting the buoyant slat or floating cover 61.

In particular, looking at FIG. 7, unwinding rotation of the cover drum in the cover extension cycle rotates shaft 40 moving pinion gear 127(*b*) down threaded shaft 122(*b*) releasing actuator block 123(*b*) which, under the influence of spring 129(*b*) pushes pin 120(*b*) opening or unseating normally closed checking valve ball 35(*b*) allowing pressurized fluid from the hydraulic/pneumatic pump 55 to rotate the cover drum in the wind up (retraction) direction overcoming buoyant forces resisting submersion of the cover.

It should be appreciated, by those skilled in hydraulic and pneumatic disciplines that bidirectional (reversible) hydraulic power source is an equivalent of the unidirectional power source 56/55 and three position control valve 54 combination shown in FIGS. 1 & 2 and 5 & 6. For example, power pack electrical drive motor 56 can be reversible thereby providing a bidirectional (reversible) hydraulic power source eliminating the necessity for the three position control valve 54.

Figure 2:
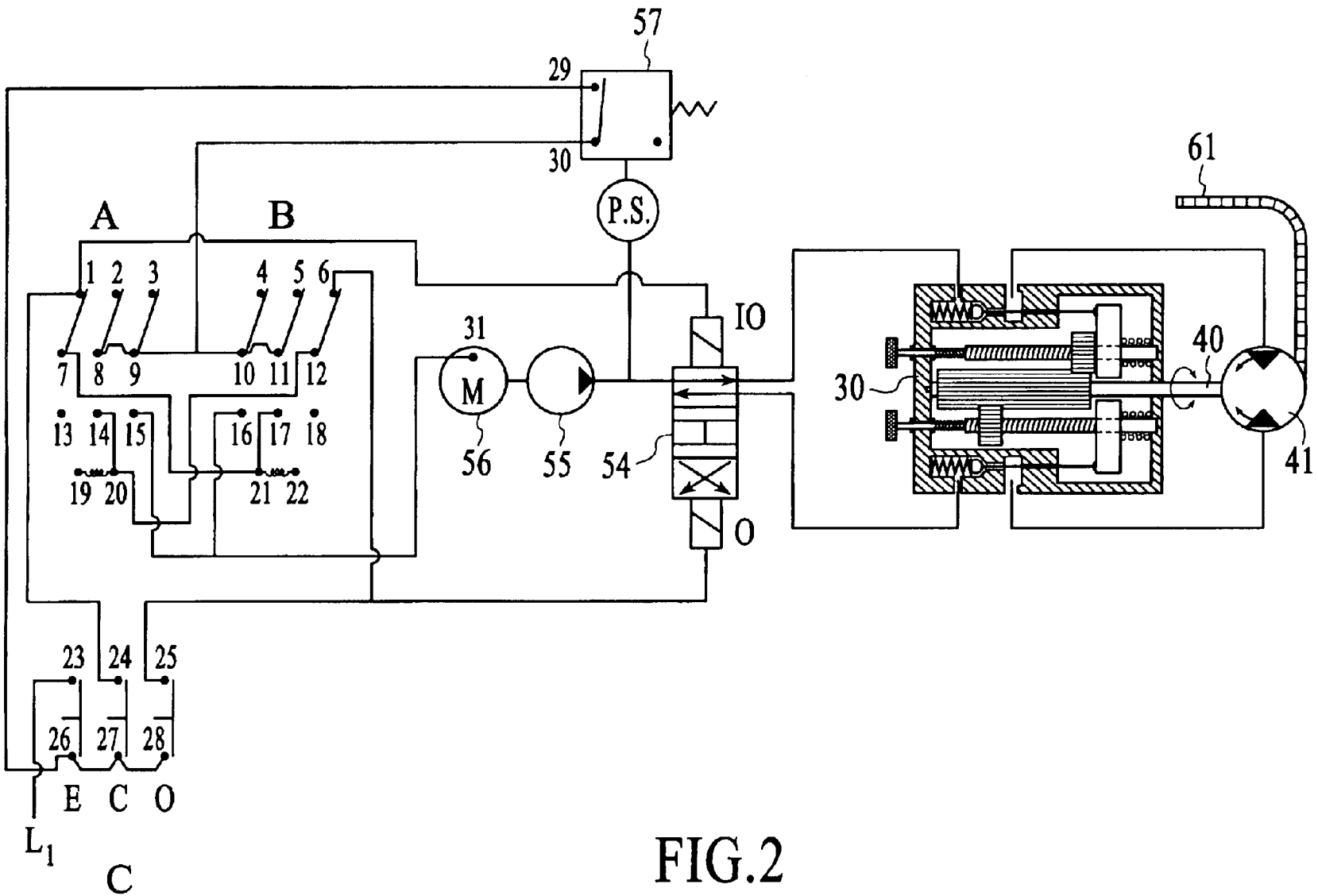
FIG. 2. illustrates electrical schematics along with the corresponding hydraulics shown in FIG. 1.

Turning to FIG. 2, an equivalent electrical holding or latching circuit with interlock and a pressure switch 30 previously described by the Applicant in U.S. patent application Ser. No. 09/829,801 filed Apr. 10, 2001 entitled AUTOMATIC POOL COVER SYSTEM USING BUOYANT-SLAT POOL COVERS is shown in conjunction with the hydraulic circuit to illustrate the advantages of the invented hydraulic/pneumatic actuation system over its electrical analogue.

The electrical analogue shown FIG. 2 includes two 3PDT (three pole—double throw) relays A and B, actuated by a push button control station C, a pressure switch 57, and power-pack components i.e. the control valve, 54, the hydraulic/pneumatic pump 55 and electrical motor 56, and limit switch 30, connected for rotating shaft 40, coupling the limit switch 30 to the hydraulic/pneumatic cover drum drive motor 40 which winds and unwinds cover 61. Power to the system is supplied from L1 through contacts 23 and 26 of the emergency stop button E, and through the normally closed contacts 29 and 30 of pressure switch 57, and common contacts 8 & 9 and 10 & 11, of relays A and B respectively. Interlock contacts 1 & 7 of A, and 6 & 12 of B, prevent relay A from being activated while relay B is "on". When push-button C is pressed (closed), current flows through terminal 27 to 24 to terminal 1 and through normally closed contact 1–7 to terminal 7 of relay coil 21 closing normally open contacts 10–16 and 11–17 for holding relay B "on" by virtue of the jumper and the power supply from the common terminal 17 to terminal 21. Solenoid C of the three-way valve 54 is energized through terminal 1, which remains energized through the "holding" of relay B after push-button C is released. With relay B energized, the normally closed contact 6-12 is open, and acts as an interlock, thus preventing relay A to be energized via push-button C. The system can be stopped anytime in the cycle by pushing push-button E (emergency) and breaking the normally closed contacts 23–26 and breaking the "holding circuit" or coil 21–22 of relay B. The power-pack motor 56 is energized through terminal 16 to 31.

Looking at FIG. 7, the limit switch device 30 previously disclosed in Applicant's U.S. patent application Ser. No. 09/829,801 filed Apr. 10, 2001 entitled AUTOMATIC POOL COVER SYSTEM USING BUOYANT-SLAT POOL COVERS includes a shaft 40 rotated by the cover drum drive motor connected to gear 125, rotating pinion gears 127(*a*) and 127(*b*) on fixed threaded shafts 122(*a*) and 122(*b*) respectively against actuator blocks 123(*a*), & 123(*b*) sliding them axially, constrained on smooth end sections of the shafts 128(*a*) & 128(*b*) of shafts. Leftward translation of actuator block 123(*a*) allows pin 120(*a*) to move leftwards seating checking ball 35(*a*) in its seat for interrupting flow from 31(*a*) to 32(*a*) stopping motor 41. Interrupting fluid flow from 31(*a*) to 32(*a*) also instantaneously and temporarily causes system pressure rise to $P_c$ at pressure switch 57, (FIG. 2) switching normally closed contacts to open, and breaking the electrical holding circuit and shutting down motor 56 and operation of the cover system. The end-point positions of the limit switch 30 are be easily adjusted by releasing lock-nuts 126 and turning knurled adjustment knobs 124(*a*) or 124(*b*). moving the pinions 127(*a*)/127(*b*) to move relative to gear 125. Re-locking of the lock-nuts 126 will again make the threaded shafts 122(*a*)/122(*b*) stationary, so that the pinions 127(*a*)/127(*b*) can only translate responsive to rotation of gear 125 by shaft 40.

Figure 3:
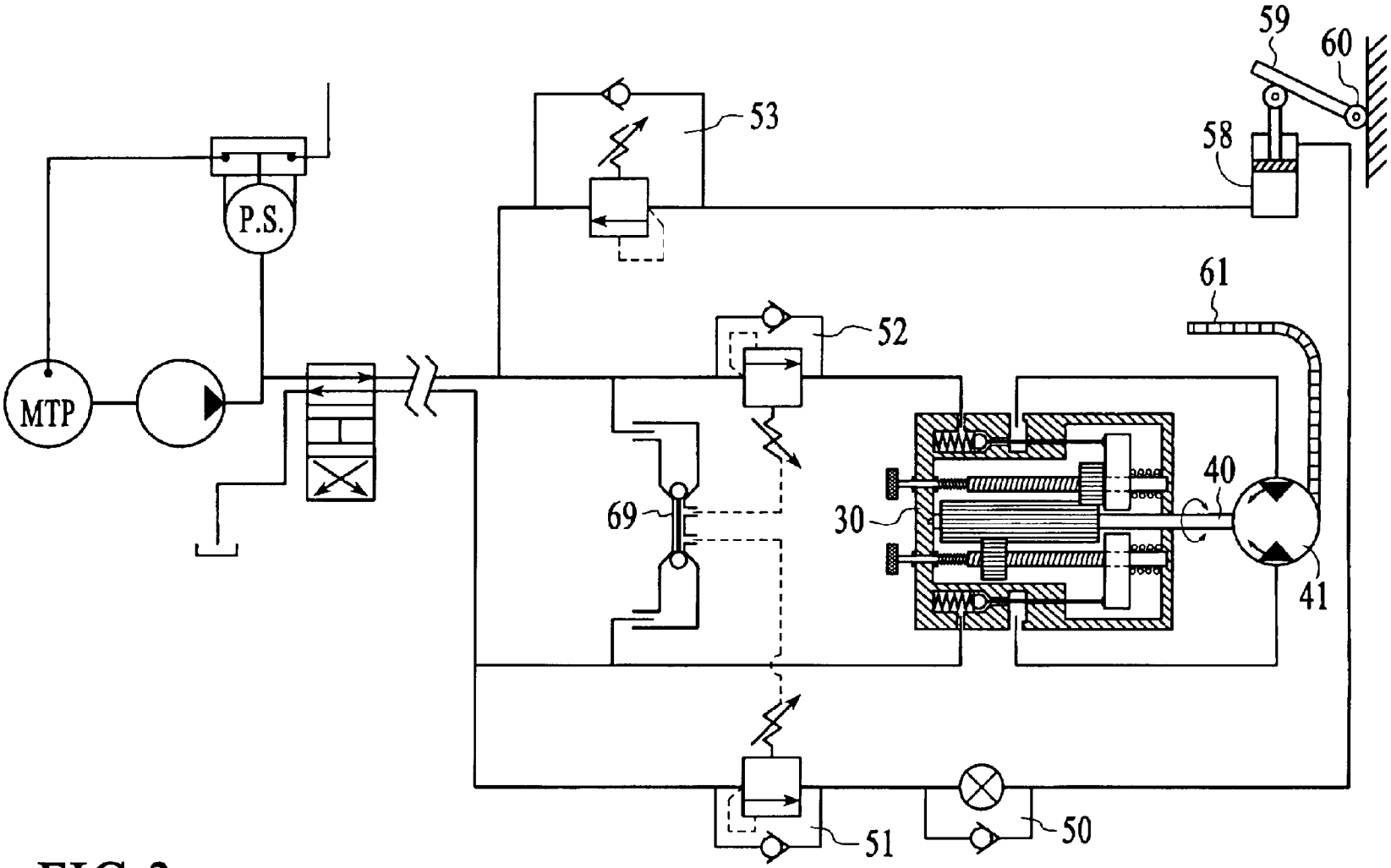
FIG. 3. illustrates a variation of the system of FIG. 1, incorporating a novel flow diverter device.

Returning to FIGS. 1 & 3 exhaust or return flow from cylinder 58 flows in line 106 through the free-flow side 109 of sequence valve 51 to line 108 and tank or reservoir 63. Similarly return or exhaust flow from motor 41 passes through line 32(*b*) and the limit switch free-flow direction to line 31(*b*) and to line 108 and tank 63.

Lines 110 and 111 vent sequence valves 51 and 52 vent to the tank 63 for proper operation. To explain, lid 59 must stay in the fully open position until the cover 61 is fully retracted, [wound around the cover drum (not shown)]. To keep lid 59 from sinking downwards due to gravity, from the open to the closed position, counterbalance valve 53 is set so that the fluid pressure in line 102 and cylinder chamber 113 is high enough to counterbalance the weight of the lid 59. Flow from line 102 to line 100 via line 101 is blocked by a check valve. When the pressure in line 108 is higher than counterbalance pressure $P_c/P_b$ in line 102 and cylinder chamber 113, pilot line 112 will cause the counterbalance valve 53 to open and allow fluid flow to line 100.

Referring to FIGS. 1 & 7, in the reverse direction, line 106 is pressurized and operates the cover motor 41 to wind the cover around the cover drum (not shown) retracting from the pool surface. In this case, the limit switch 30 blocks flow to the motor 41 i.e., traveling pinion 127(*b*) moves sliding block 123(*b*) and allowing pin 120(*b*) to translate, seating ball 35(*b*) to block flow from passage 31(*b*) to 32(*b*). As before, this will cause fluid pressure to increase from $P_a$ to $P_b$ which will cause the pilot line pressure in sequence valve 51 to open and allow flow to line 108. Pressure will then build sufficiently to overcome the counter-balance pressure set by valve 53 and start rod cylinder 58 translating downward closing the lid. When the cylinder reaches the end of travel, pressure will build until the pressure switch opens and breaks the electrical connection to the 'holding' circuit and shutting the system down automatically.

Looking at FIG. 1, a one-way shut-off valve 50 interrupts line 108 of the system for holding the lid 59 in the open position, blocking fluid flow to preventing the cylinder 58 from retracting. Shut off valve 50 is necessary in order to set or adjust cover travel end-points, and the lid must be held open during the adjustment process. For example if the limit switch 30 were incorrectly set to shut off before the cover is fully retracted, the sequence valve would allow the lid to come down on top of the cover damaging the cover and even the lid. The one-way shut-off valve 50 incorporated into line 106 of the system permits the lid 59 to be opened and held in the open position, blocking fluid flow in the shut-off position preventing the cylinder 58 from retracting. In this case, pressure then builds against the shut-off valve instead and causes the pressure switch 80 to activate shutting down cycle operation.

Turning now to FIGS. 3, 4, 5 and 6 a flow diverter device 69 is described which can be incorporated into the invented hydraulic/pneumatic actuation system for eliminating two of the four hydraulic supply lines shown in FIG. 1 connecting between the remote power-pack 55/56, the limit switch 30, hydraulic drive motor 41 and actuating cylinder 58. This is achieved by isolating the sequence valve vent ports 110 & 111 (FIG. 1) from the pressure lines and allowing the vents to be connected to the return lines while at low pressure.

Figure 4:
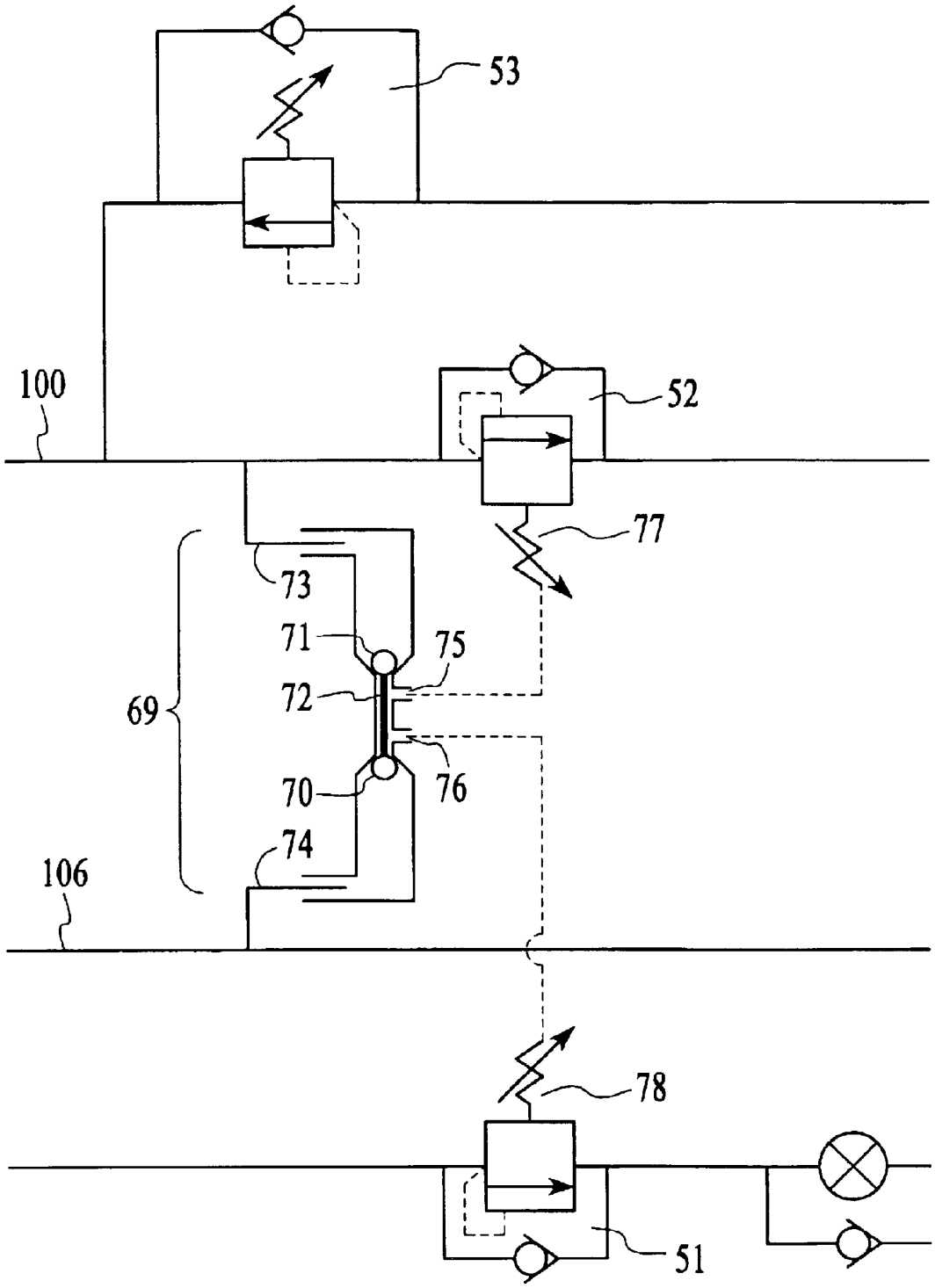
FIG. 4 illustrates the flow diverter device which allows required venting of the sequence valves to the system return lines.
Figure 5:
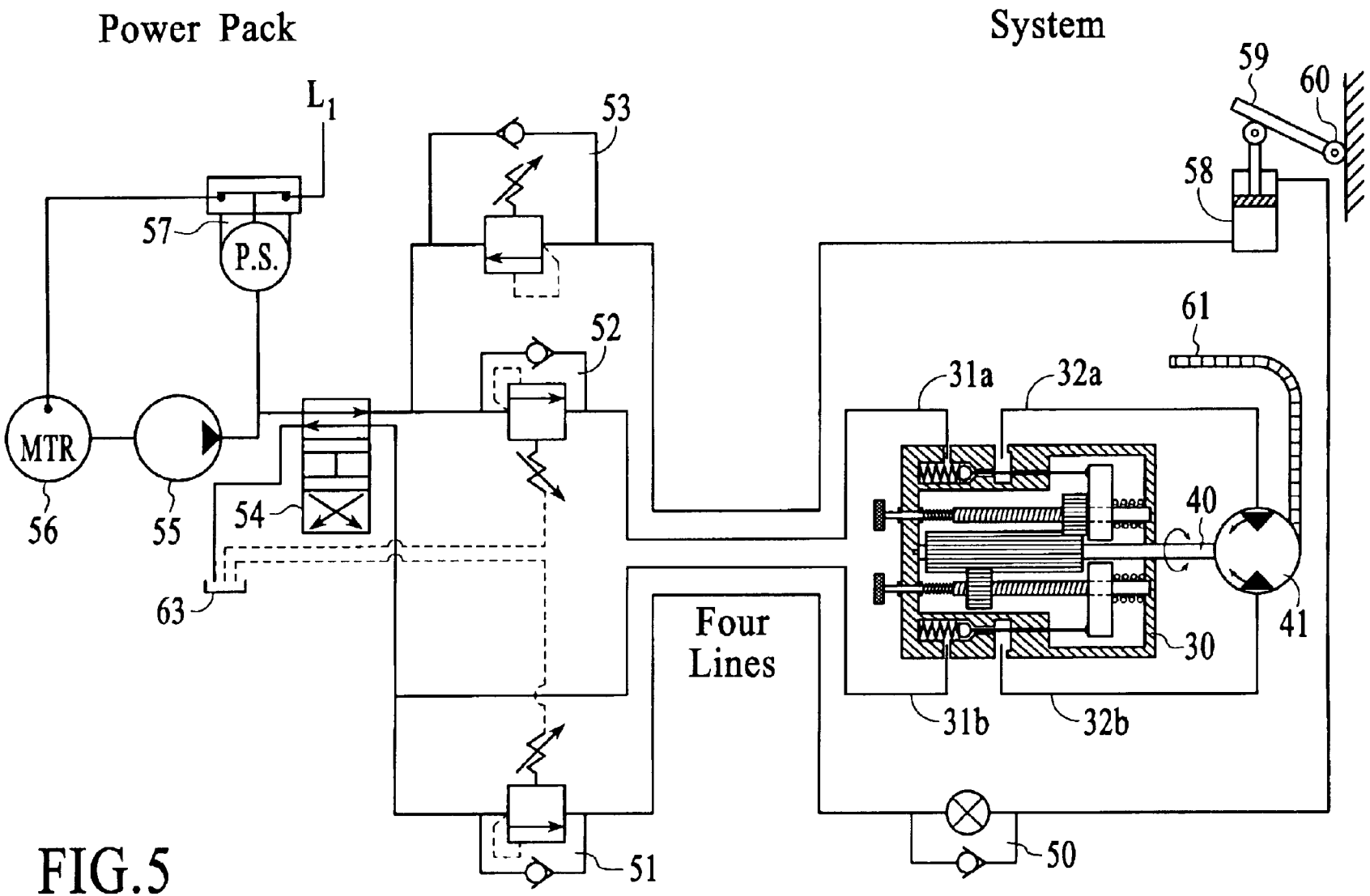
FIG. 5. illustrates a system without the diverter device where all of the control valves are located at power pack/pump location requiring at least four hydraulic supply lines for powering the cover drive motor and the lid actuator cylinder.
Figure 6:
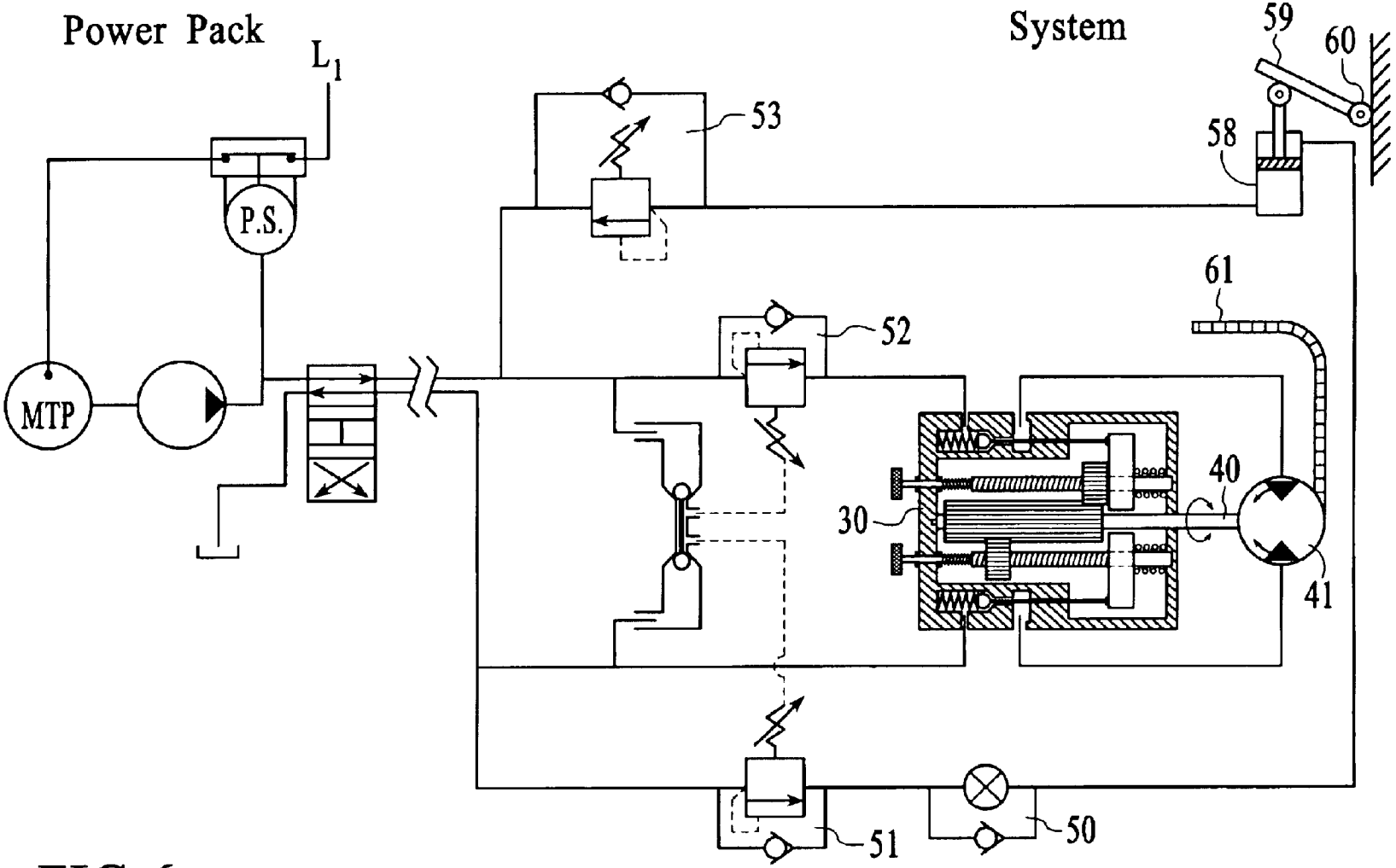
FIG. 6. illustrates a system with the diverter device added, enabling all of the valves to be located at the pool side, and only two supply lines required to supply the system from the power pack.

With reference to FIG. 4, when line 100 is pressurized for opening lid 59 while retracting/extending the cover 61, port 73 of diverter device 69 is also pressurized, forcing check valve 71 to close. Pin 72 then is pushed against ball 70 to allow flow from ports 75 and 76 past check valve ball 70 held open by pin 71 to port 74 and on through system return line 106 during cover extension until complete cover retraction. As shown, both sequence valves are fully vented as required for the proper operation of the sequence valves.

In the cover retraction, pressure in line 106 results in pressure through port 74 to force check valve ball 70 to seat and shut-off flow, while at the same time pushing pin 72 to push against ball 71, and keeping it open allowing flow from ports 75 and 76 to port 73 and to return line 100 in the cover retraction cycle.

Returning to FIG. 1, the speed of the cylinder shaft 114 moves within hydraulic/pneumatic cylinder 58 traversing to the upward and open position, can be adjusted by bleeding off flow over a timed interval. With the lid 59 in the normally closed position, timer 83 is energized to start the to cover extension cycle opening valve 80 which allows a controlled amount of flow through flow control section 80(*a*) to slow down opening of the lid 59. Care should be taken to set the timer so that it times out before the lid is fully open. While valve 80 is open to tank, pressure will not build up sufficiently to cause sequence valve 52 to open and start the cover drive operation.

A similar device 81 can be incorporated into line 108 to slow extension of the cover to offset buoyancy/gravity forces accelerating of extension of the cover until the leading or front end(s) of the cover breaks water surface and changes from moving vertically due to buoyancy/gravity to moving horizontally floating on the pool surface. Again, the timer 84 should be set just long enough for the initial duration of travel, after which the valve 81 will close whereupon the cover extension will accelerate to a full travel speed determined by buoyancy or gravity mechanical factors opposing those forces.

Particular applications for the invented hydraulic/pneumatic actuation system are described in the Applicants co-pending applications entitled: TRAVELING COVER BENCH SYSTEM WITH HYDRAULIC FLUID ACTUATOR, filed Jan. 14, 2004 Ser. No. 10/758,705 and MODULAR LID AND ACTUATOR FOR UNDERWATER POOL COVER DRUM ENCLOSURE also filed Jan. 14, 2004 Ser. No. 10/758,149, each of which contemplate hydraulic drive systems for the pool cover drums of automatic swimming pool cover systems per the teachings of Applicant's U.S. Pat. Nos. 5,184,357 and 5,546,751.

The invented hydraulic or pneumatic actuation system has been in context of hydraulically powered, buoyant cover, automatic pool cover systems with at least two different bidirectional, hydraulically driven elements each of which have or include mechanical end points for limiting, arresting or stopping further mechanical movement or travel of the driven element inherently generating pressure increases in a common hydraulic/pneumatic circuit, namely: (i) a bidirectional hydraulic/pneumatic cylinder for opening and closing a lid covering a pool cover assembly trench in the bottom of, or an underwater sidewall recess of a swimming pool, and (ii) a combination of a mechanical limit switch and a bidirectional hydraulic drive which rotates both a shaft of the limit switch setting mechanical end points, and the underwater cover drum unwinding the buoyant pool cover in the cover extension cycle, and winding up the buoyant cover retracting from the pool surface in the retraction cycle.

It should be recognized that engineers and designers that design and build hydraulic or pneumatic actuation systems which included a plurality of hydraulic/pneumatic components having bidirectional directional elements that are equivalent to the invented system described above for hydraulically powered, buoyant cover, automatic pool cover systems, i.e., systems that perform substantially the same function, in substantially the same way to achieve substantially the same result as those components described and the invented system as described and specified in the appended claims.

I claim:

1. An actuation system for hydraulic systems in a common hydraulic circuit comprising in combination:

a) a first hydraulic driven component having a bidirectional driven element with at least two mechanical end points limiting, arresting and stopping further mechanical movement of the bidirectional element for inherently providing an increase in hydraulic pressure in the hydraulic circuit upon being hydraulically driven against a mechanical end point;

b) a second hydraulically driven component having a bidirectional driven element with at least two mechanical end points limiting, arresting and stopping further mechanical movement of its bidirectional driven element for inherently providing an increase in hydraulic pressure in the hydraulic circuit upon being hydraulically driven against a mechanical end point;

c) a source of reversible hydraulic power including a motor driving a pump pumping a hydraulic liquid from a containing reservoir for supplying hydraulic liquid at least at a pre-set pressure ($P_a$) in a forward and a reverse direction;

d) a first hydraulic power supply/return line connected between the source of hydraulic power and the first hydraulic driven component between one of the two mechanical end points and its bidirectional driven element;

e) a first vent sequence valve in a second hydraulic power supply/return line connected between the source of hydraulic power and the second hydraulic driven component between one of its two mechanical end points and its bidirectional driven element;

f) a third hydraulic power supply/return line connected between the source of hydraulic power and the second hydraulic driven component between other of the two mechanical end points and its bidirectional driven element, completing the common hydraulic circuit including the first and second hydraulic driven components and the source of hydraulic power;

g) a pressure switch monitoring pressure of the hydraulic liquid pumped from the source of hydraulic power for turning off the source of hydraulic power at a pre-set pressure level ($P_{off}$);

forward hydraulic power being supplied to the first hydraulic driven component for driving it's bidirectional element to one of its mechanical end points via the first hydraulic power supply/return line generating a first pressure increase ($P_b$) in the first and second supply/return lines switching the first vent sequence valve to supply hydraulic power to the second hydraulically driven component for driving its bidirectional element to one of its mechanical end points generating a second pressure level $P_c$ in the second supply/return line, where $P_a<P_b<P_{off}\leqq P_c$ shutting off the system.

2. The actuation system for hydraulic systems of claim 1 and further including:

h) a fourth hydraulic power supply/return line connected between the source of hydraulic power and the first hydraulic driven component between other of its two mechanical end points and its bidirectional driven element, completing the common hydraulic circuit including the first and second hydraulic driven components and the source of hydraulic power;

i) a second vent sequence valve in the fourth hydraulic power supply/return line connected between the source of hydraulic power and the first hydraulic driven component between the other of its of the two mechanical end points and its bidirectional driven element;

reverse hydraulic power being supplied to the second hydraulic driven component for driving it's bidirectional element to the other of its mechanical end points via the third hydraulic power supply/return line generating a first pressure increase ($P_b$) in the third and fourth supply/return lines switching the second vent sequence valve to supply hydraulic power to the first hydraulically driven component for driving its bidirectional element to the other of its mechanical end points generating a second pressure level $P_c$ in the second supply/return line, where $P_a<P_b<P_{off}\leqq P_c$ shutting off the system.

3. The actuation system for hydraulic systems of claim 2 and further including:

j) a manual shut off valve in the fourth hydraulic power supply/return line for interrupting supply flow to, but allowing return flow hydraulic liquid from the first hydraulic driven component connected between the second sequence valve and the first hydraulic driven component to manually hold its bidirectional element at any position between the particular one of its two mechanical end points and the other of its two mechanical end points.

4. The actuation system for hydraulic systems of claim 2 and further including:

k) a first counterbalance valve having a free flow bypass line allowing supply flow with a check valve stopping return flow of hydraulic liquid in that bypass line switching to allow return flow of hydraulic pressure in the first hydraulic supply/return line at a pressure level ($P_d$) that is greater than the pressure level in the third supply/return line when reverse hydraulic power is supplied via the fourth supply/return line to the first driven hydraulic component for driving its bidirectional element from the particular one of its two mechanical end points to the other of its two mechanical end points, whereby, the bidirectional element of the first hydraulically driven component is held against the particular one of its mechanical end points until the second vent sequence valve switches to supply hydraulic power to the first hydraulically driven component for driving its bidirectional element to the other of its mechanical end points.

5. The actuation system for hydraulic systems of claim 1 and further including:

l) a timer controlled valve draining forward circulating supply hydraulic liquid at a set rate from the first supply/return line to the reservoir of the reversible hydraulic power source for a set time connected between the source of forward hydraulic power and the first driven hydraulic component for initially slowing translation of its bidirectional element toward the particular one of its two mechanical end points.

6. The actuation system for hydraulic systems of claim 2 and further including:

m) a timer controlled valve draining reverse circulating supply hydraulic liquid at a set rate from the third supply/return line to the reservoir of the reversible hydraulic power source for a set time connected between the source of reverse hydraulic power and the second driven hydraulic component for initially slowing translation of its bidirectional element toward the particular other of its two mechanical end points.

7. The actuation system for hydraulic systems of claim 2 wherein the first and second sequence valves each include a vent port line connecting to the reservoir of the reversible source of hydraulic power for allowing movement of a valve element in each sequence from a position interrupting supply hydraulic liquid flow in the particular supply/return line its is incorporated into, to a position allowing supply hydraulic liquid flow in the particular supply/return line, and further including in combination therewith:

n) a diverter valve connecting to:

(i) the respective vent port lines of the sequence valves, (ii) to the second hydraulic supply/return line between the source of reversible hydraulic power and the first sequence valve, and (iii) to the third hydraulic supply/return between the source of reversible hydraulic power the second hydraulic driven component, the diverter valve having means for simultaneously isolating high pressure supply flow of hydraulic liquid respectively in the forward direction and in the reverse direction from the second and third hydraulic supply/return lines and directing (A) hydraulic liquid flow from the respective vent port lines of the respective sequence valves to the third hydraulic supply/return functioning as a return line when source of reversible hydraulic power supplies hydraulic liquid at least at a pre-set pressure ($P_a$) in the forward direction, and (B) to the second hydraulic supply/return functioning as a return line when source of reversible hydraulic power supplies hydraulic liquid at least at a pre-set pressure ($P_a$) in the reverse direction.

8. An actuation system for pneumatic systems in a common pneumatic circuit comprising in combination:

a) a first pneumatic driven component having a bidirectional driven element with at least two mechanical end points limiting, arresting and stopping further mechanical movement for inherently providing an increase in pneumatic pressure in the pneumatic circuit upon being pneumatically against a mechanical end point;

b) a second pneumatically driven component having a bidirectional driven element with at least two mechanical end points limiting, arresting and stopping further mechanical movement of its bidirectional driven element for inherently providing an increase in pneumatic pressure in the pneumatic circuit upon being pneumatically driven against a mechanical end point;

c) a source of reversible pneumatic power including a motor driving a pneumatic pump pumping a pneumatic fluid from a containing reservoir for supplying a pneumatic fluid at least at a pre-set pressure ($P_a$);

d) a first pneumatic power supply/return line connected between the source of pneumatic power and the first pneumatic driven component between one of the two mechanical end points and its bidirectional driven element;

e) a first vent sequence valve in a second pneumatic power supply/return line connected between the source of pneumatic power and the second pneumatic driven component between one of the two mechanical end points and its bidirectional driven element;

f) a third pneumatic power supply/return line connected between the source of pneumatic power and the second pneumatic driven component between the other of the two mechanical end points and its bidirectional driven element, completing a common pneumatic circuit including the first and second pneumatic driven components and the source of pneumatic power;

g) a pressure switch monitoring pressure from the source of pneumatic power for turning off the source of pneumatic power at a pre-set pressure level ($P_{off}$);

pneumatic power being supplied to the first pneumatic driven component for driving it's bidirectional element to one of its mechanical end points via the first pneumatic power supply/return line generating a first pressure increase ($P_b$) in the first and second supply/return lines switching the first vent sequence valve to supply pneumatic power to the second pneumatically driven component for driving its bidirectional element to one of its mechanical end points generating a second pressure level $P_c$ in the second supply/return line, where $P_a<P_b<P_{off}\leqq P_c$ shutting off the system.

9. A method for actuating a system of fluidic components, each component having a bidirectional driven element with at least two mechanical end points limiting, arresting and stopping further mechanical movement of the bidirectional element for inherently providing an increase in fluidic pressure in a common fluidic circuit upon being driven against a mechanical end point, comprising the following steps:

a) providing a source of reversible fluidic power including a motor driving a fluidic pump pumping a fluid from a containing reservoir for supplying a fluid at a pre-set pressure ($P_a$);

b) supplying a first supply/return line connected between the source of hydraulic power and a first particular fluidic driven component between one of the two mechanical end points and its bidirectional driven element for inherently increasing fluidic pressure to pressure ($P_b$) in the first supply line and in a second fluidic power supply/return line connected between the source of fluidic power and a particular second fluidic driven component between one of the two mechanical end points and its bidirectional driven element to where $P_b>P_a$;

c) providing a third fluidic power supply/return line connected between the source of fluidic power and the second hydraulic driven component between the other of the two mechanical end points and its bidirectional driven element completing a common fluidic circuit of the first and second particular fluidic driven components and the source of fluidic power;

d) providing a pressure switch monitoring pressure of the fluid from the source of fluidic power for turning off the source of fluidic power at a pre-set pressure level ($P_{off}$);

e) providing first vent sequence valve in the second fluidic power supply/return line connected between the source of fluidic power and the particular second fluidic driven component for switching the first vent sequence valve to supply fluidic power to the second fluidic driven component for driving its bidirectional element to one of its mechanical end points generating a second pressure level ($P_c$) in the second supply/return line, where $P_a<P_b<P_{off}\leqq P_c$ shutting off the system.

* * * * *